United States Patent [19]

Franek et al.

[11] 4,425,778

[45] Jan. 17, 1984

[54] METHOD AND TOOL FOR REDRAWING

[75] Inventors: Josef T. Franek, Chorleywood; Paul Porucznik, St Albans, both of England

[73] Assignee: Metal Box Limited, Reading, Great Britain

[21] Appl. No.: 276,359

[22] PCT Filed: Oct. 28, 1980

[86] PCT No.: PCT/GB80/00184

§ 371 Date: Jun. 17, 1981

§ 102(e) Date: Jun. 17, 1981

[87] PCT Pub. No.: WO81/01259

PCT Pub. Date: May 14, 1981

[30] Foreign Application Priority Data

Oct. 31, 1979 [GB] United Kingdom ..... 7937773

[51] Int. Cl.[3] ..... B21D 22/00

[52] U.S. Cl. ..... 72/347; 72/349; 72/350

[58] Field of Search ..... 72/349, 347, 350, 351, 72/467

[56] References Cited

U.S. PATENT DOCUMENTS

| | | | |
|---|---|---|---|
| 344,457 | 6/1886 | Paull et al. | 72/349 |
| 1,935,854 | 11/1933 | McCreary | 72/349 |
| 3,793,871 | 2/1974 | Kinghorn | 72/349 |
| 4,193,279 | 3/1980 | Maeder | 72/349 |

FOREIGN PATENT DOCUMENTS

| | | | |
|---|---|---|---|
| 890701 | 1/1972 | Canada | 72/350 |

OTHER PUBLICATIONS

Eary & Reed, Techniques of Press Working Sheet Metal, 1974, pp. 112 and 113.

*Primary Examiner*—Francis S. Husar
*Assistant Examiner*—David B. Jones
*Attorney, Agent, or Firm*—Diller, Ramik & Wight

[57] ABSTRACT

In manufacture of a can body by drawing a cup from a blank and subsequently redrawing the cup, one or more redrawing steps are performed by pulling the sidewall of the cup (2) by means of a punch (12) through an S-shaped path (30,24,31), whereby the wall is bent first in one direction and then in the other, to reduce its diameter, which is then reduced further in a convergent portion (20) of the die (10). The bending induces back tensions which stretch the metal and reduce its wall thickness.

15 Claims, 10 Drawing Figures

FIG. 1 III.

FIG. 6 III.

METHOD AND TOOL FOR REDRAWING

TECHNICAL FIELD

The invention relates to a method for redrawing a predrawn cup, particularly a cup of thin metal in a process for making a can body, in a tool including a punch and a die; the invention relates equally to a said tool for performing such a redrawing operation.

BACKGROUND ART

Redrawing is performed in the so-called drawing-redrawing method (DRD method) which is hereinafter described in more detail. The redrawing step used in this method has some inherent disadvantages which will also be explained.

DISCUSSION OF THE INVENTION

The invention provides a method and tooling for imparting substantial wall thickness reduction during the redrawing operation of the cup drawn from slightly wax lubricated material, without applying the extreme compression usually necessary in a typical wall-ironing operation, by achieving wall thickness reduction subjecting the material to simultaneous bending and tension. This is followed, if desired, by slight sizing (i.e. corrective ironing) to ensure for the consistency of final wall thickness, whilst some additional lubricant may be used, the method of the invention does not call for essential provision of such lubricant, and therefore can avoid the requirement to wash the finished article to remove the residual lubricant.

The invention in a first aspect provides a method for redrawing a predrawn cup in a tool comprising an annular die and an annular blank holder or guide ring having a common axis and a punch movable forwardly along the axis through first the blank holder and then the die, wherein the wall of the predrawn cup, being of predetermined initial thickness, is drawn by the punch through a path which is delimited by parts of the tool and is substantially S-shaped in radial section, and the path includes (a) a first curved portion defined by a radiused leading outer edge of the blank holder, the first curved portion being in contact with the interior of the cup and the wall being bent convexly in the first curved portion so that the diameter of the cup wall is reduced; (b) an optional transitional portion between the blank holder and the die, in which the convexly bent wall is straightened; and (c) a second curved portion defined by a radiused rear inner edge of the die, the second curved portion being in contact with the exterior of the cup and the straightened wall of the cup being bent concavely thereon, the wall, after leaving the second curved portion, passing through a convergent part of the die which leads forwardly from the second curved portion and in which the wall is in contact with the die but out of contact with the punch, the radii of the two curved portions being three to four times the initial thickness of the wall. The wall thickness is reduced mainly in the second curved portion and the converging portion of the path.

In a preferred embodiment the method includes a sizing step. The method of the invention, irrespective whether or not it includes sizing, represents a single step. However several such steps may be repeated discretely in succession. A method according to the invention will be referred to herein as a "bend stretching" method, since the wall thickness is reduced by stretching due to back tension induced mainly by bending the material of the wall through the S-shaped path.

The invention in a second aspect also provides a tool for the redrawing of a predrawn cup having a predetermined wall thickness, the tool comprising an annular die and an annular blank holder having a common axis, and a punch movable along the axis through first the blank holder and then the die, the leading outer edge of the blank holder and the rear inner edge of the die being radiused and the bore of the die, leading forward from its said inner edge, being convergent, the die and blank holder optionally having opposed radial rear and leading faces respectively which are substantially planar, so that when the blank holder and the die are in position for redrawing, the cup wall can be drawn between them by the punch in a substantially S-shaped path delimited successively by the blank holder leading outer edge, the said rear and leading faces (if provided), the rear inner edge of the die, and the convergent bore of the latter. The radii of the two radiused edges are from three to four times the initial wall thickness of the cup.

In one preferred embodiment the transitional portion of the path defined between the two planar faces comprises a rectilinear flat region joining the first curved portion and the second curved portion of the path by mutually-parallel portions of the opposed radial faces of the blank holder and of the die.

The convergent bore of the die preferably merges into a throat of a substantially constant cross-sectional area. The throat preferably merges into a divergent bore.

The tool may include a nest ring situated behind the die and radially outwardly of the blank holder. The nest ring may have a concave portion situated defining the outward boundary of the first curved portion of the path.

BRIEF DESCRIPTION OF THE DRAWINGS

The invention will now be described, by way of example, with reference to the accompanying diagrammatic drawings, in which.

MODE OF CARRYING OUT THE INVENTION

Figures 1, 1I, 1V:
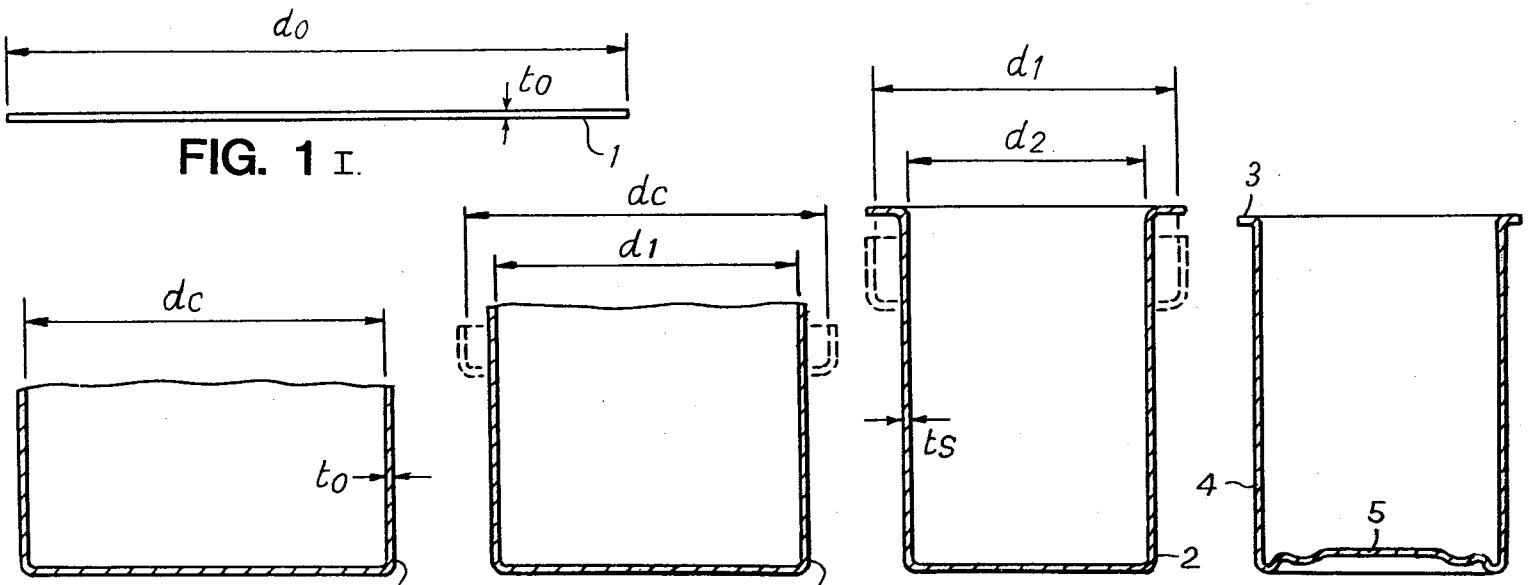
FIGS. 1(*i*)–(*v*) illustrates the steps in a known DRD method of can manufacture.

FIG. 1(*i*) shows a circular metal disc or blank 1 of a diameter $d_o$, typically obtained by stamping from a pre-lubricated or pre-waxed sheet or strip in a preliminary blanking operation. In the first step of a known draw-redraw (DRD) method, namely the drawing or cupping step, the disc is drawn into a cup of a diameter $d_c$ 2, FIG. 1(*ii*). The cupping reduction $R_c$, usually expressed as a percentage, is given by the expression $R_c=(d_o-d_c)/d_o$. The cupping reduction can be as high as 50%, although in practice about 35% is an optimum value. The drawn cup 2 is redrawn to reduce its diameter from $d_c$ to a value $d_1$, FIG. 1(*iii*). The diameter reduction $R_1$, so obtained, given by the expression $R_1=(d_1-d_c)/d_c$, would normally be not more than about 25%.

Typically, a second redrawing operation follows as a third step, FIG. 1(*iv*), in which the diameter is reduced in a reduction $R_2$ from the diameter $d_1$ to a diameter $d_2$, where $R_2=(d_2-d_1)/d_1$ reduction $R_2$ being usually again no more than about 25%. In a final operation the redrawn cup 2 is trimmed to leave an end flange 3 of uniform radial width. At the same time the base of the cup may be re-formed, typically to a shape such as shown at 4 in FIG. 1(*v*), to satisfy the processing requirements. FIG. 1(*v*) shows the cup in the form of a now-finished can 4. Usually, no washing operation will be necessary to remove residual lubricant or wax from the finished can 4.

Figure 2:
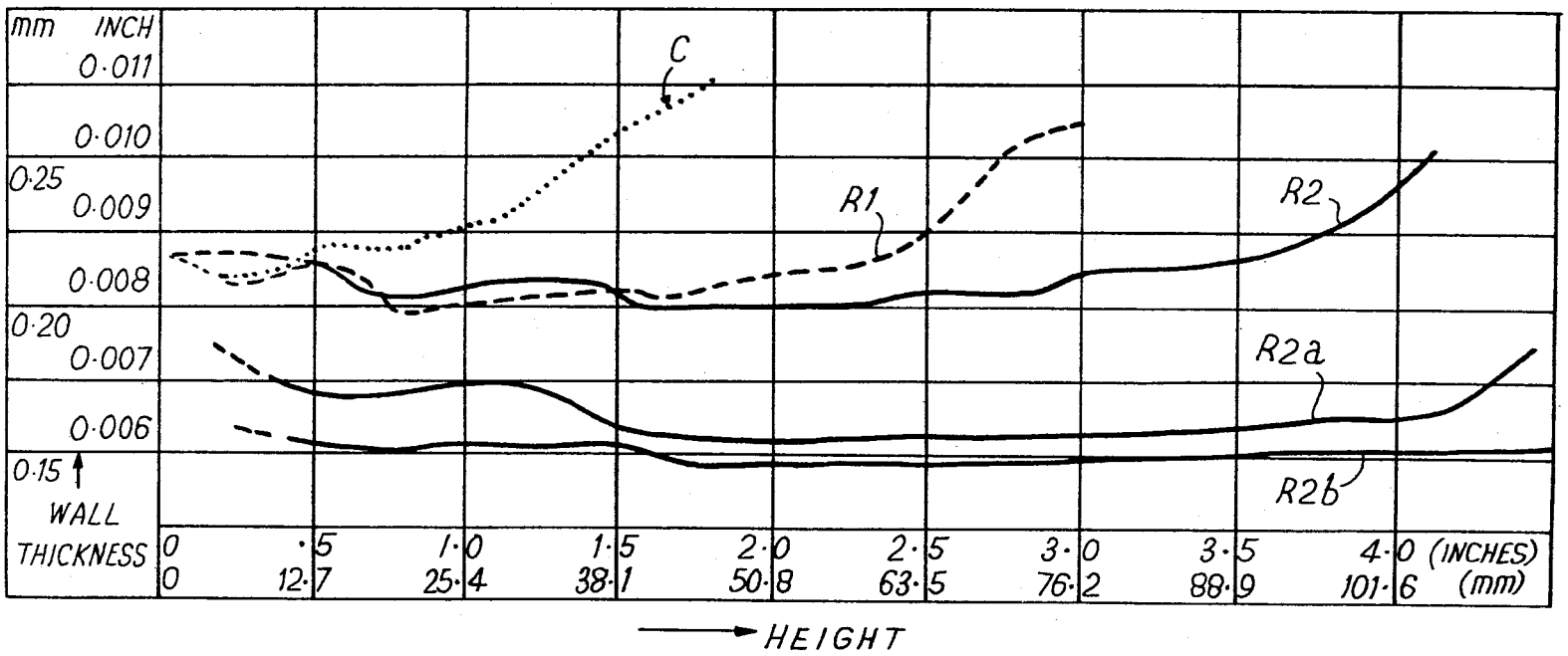
FIG. 2 is a graph showing wall thickness of a can made by the known DRD method and of a can made by the "bend stretching" method according to the invention.

Although in FIG. 1 the wall thickness in all the sections is shown the same for the sake of simplicity, in practice this is not so. FIG. 2 shows in graphical form how wall thickness varies along the height of a cup at various stages both in the known DRD method and in the bend stretching method according to the invention, to be described below. The cup 2 of FIG. 1(*ii*), after cupping, represented by the curve C, and after the first redrawing operation (FIG. 1(*iii*)), represented by the curve R1, are the same both for the known DRD method and the bend stretching method; only the second redrawing operations differ. The cup after its second redrawing operation by the DRD method is represented by the curve R2, in FIG. 2, whilst the cup after a second redrawing operation according to the invention (without wall thickness sizing) is represented by the curve R2*a*. The cup after a second redrawing operation according to the invention, with wall thickness sizing, is represented by the curve R2*b*.

The curves in FIG. 2 were plotted using results from experimental work to determine the influence of tool parameters on wall thickness variation during can manufacture. For this purpose the pre-waxed metal sheet, from which the blank 1 (FIG. 1) was formed, was 0.0087 in (0.22 mm) thick. As can be seen from curve C in FIG. 2, during the cupping operation a gradual increase in wall thickness takes place from the original value to about 0.011 in (0.28 mm), so that the wall of the finished cup 2 (FIG. 1(*ii*)) is considerably thicker at its open end than at its bottom. When the cup is reformed in the first redrawing step, FIG. 1(*iii*), its wall thickness is reduced to about 0.0080 in (0.20 mm), except for about the uppermost 25% of its height in which the wall thickness gradually increases to about 0.0105 in (0.267 mm), as will be apparant from the curve R1.

After the second redrawing step the wall thickness remains at about 0.0080 in (0.20 mm) except for approximately the last 20% of the height at the top of the can which increases gradually in thickness up to 0.010 in (0.254 mm), as will be apparent from the curve R2.

When the tools for the second redrawing operation were modified according to the invention, then without any wall sizing the wall thickness of the can was reduced to 0.0062 in (0.157 mm) over most of the can the thickness of the rest of the can wall being below 0.007 (0.178 mm). Only the area in the immediate vicinity of the upper edge of the can is slightly thicker, as shown by the curve R2*a*.

The introduction of sizing to the second redrawing operation, in a method according to the invention, keeps the wall thickness very close to 0.0060 in (0.152 mm) throughout the whole height of the can, as will be seen from the curve R2*b*.

It will be evident from the foregoing that the can height is proportionally increased in the bend-stretching method as compared with the known DRD method, so that the diameter $d_o$ of the blank may be smaller than that needed for the same can made by the DRD method. This represents considerable savings in material. Furthermore, calculation of the required blank diameter is easier. Also the adverse influence caused by "ears and valleys" due to anisotropy of material is diminished, so that a smaller amount of material can be allowed for flange trimming purposes whilst still ensuring a clean uninterrupted flange 3.

Figure 3:
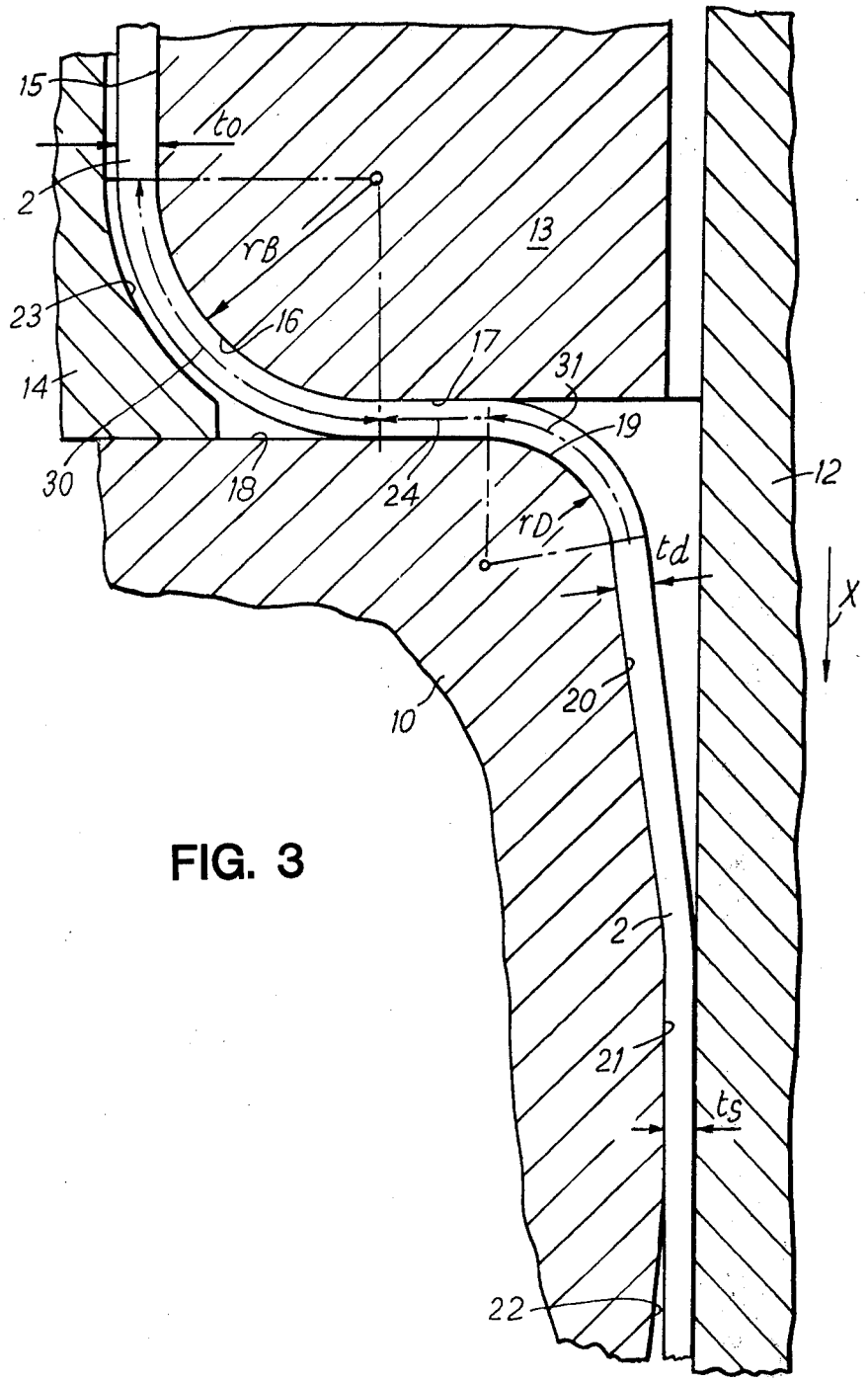
FIG. 3 shows details of a tool for carrying out a bend stretching method according to the invention.

FIG. 3 shows in detail the second redrawing operation of the cup 2, with sizing according to the invention. The tool comprises using a tool according to the invention. The tool comprises an annular die 10, a punch 12, a blank holder 13 and a nest ring 14, all being arranged on a common axis, not shown.

The direction of movement of the punch 12, through first the blank holder 13 and then the die 10, is indicated by the arrow X. The terms "leading", "rear" and the like, as used herein, relate to this direction of motion.

In the illustrated example the blank holder 13 has a substantially cylindrical outer face 15 which merges via a radiused leading outer edge 16, having a radius $r_B$, into a substantially flat, leading radial forward face 17. The die 10 has a substantially flat, radial rear face 18 opposed to the face 17. The face 18 merges, via a radiused rear inner edge 19 having a radius $r_D$, into a convergent bore 20 which is generally frustoconical. The bore 20 merges into a substantially cylindrical die throat 21, which in turn leads into a divergent bore 22. The generatrix of the convergent bore 20 may be a tractrix instead of a straight line as is the case in the frusto-conical bore shown.

The surface of the nest ring 14 may if desired have a concave portion 23 opposite the radiused edge 16 of the blank holder.

The adjacent and mutually parallel portions of the end faces 17,18 of the blank holder 13 and die 10 respectively define a radially-straight annular gap 24 between them.

As is apparent from FIG. 3, the cup 2 is guided on, and controlled, by the blank holder 13 and (if necessary) the nest ring 14. This is to prevent any tendency for wrinkles forming when the wall of the cup is drawn around the radiused edge 16.

The cup 2 is initially positioned so that its flat bottom rests on the rear face 18 of the die, with the leading face 17 of the blank holder 13 resting on the flat bottom, the punch 12 being retracted behind the latter. As the punch moves forward in the direction X, it engages the flat bottom of the cup 2 and pushes it forward, thereby pulling the cup wall forward through a path defined by the various elements 10,12,13 of the tool. This path is substantially S-shaped in radial section, and includes: (a) a first curved path portion or region 30 defined by the radiused edge 16; (b) a transitional portion consisting of the gap 24; (c) a second curved path portion or region 31 defined by the radiused edge 19; and finally a convergent portion defined by the convergent die bore 20.

Because of the reduction of wall diameter of the cup 2 as its wall is pulled by the punch 12 through and bent in this S-shaped path, back tension is induced in the metal of the wall. This tension decreases gradually from the die throat 21 to the rear end of the curved portion 30 of the path.

Up to the curved portion 30, the wall thickness $t_o$ remains unchanged. In the path portion 30, the wall is bent around the radiused edge 16, and simultaneously the diameter of the cup is reduced. The resultant back tension in the cup wall increased steadily, due partly to the hoop stress resulting from diameter reduction and friction between the cup wall and the blank holder 13, and partly to bending stresses which, in the region 30, are tensile at the outer surface of the cup wall and compressive at its inner surface (this situation then being reversed as the wall passes through the region 31, as will be seen).

In the transitional region 24, the resultant back tension in the cup wall is further increased steadily, as a result of the hoop stress induced by diameter reduction and friction forces between the cup wall and the faces 17,18.

In the region 31 there is a still further increase in resultant back tension, due to hoop stress, resulting partly from diameter reduction and friction between the cup wall and the surface of the die 10, radiused edge 19, but mainly from bending stresses which in this region are compressive at the outer surface of the cup wall and tensile at its inner surface.

From the region 31, the cup wall material passes along the convergent die face 20 into the die throat 21, where it is sized between the die 10 and the punch 12 to its final thickness $t_s$. In and after the die throat 21, the material is pulled forward by the punch 12, whilst still subjected to the resultant back tension explained above.

Generally it has been observed that if the original thickness $t_o$ of the can wall was about 0.0080 in (0.20 mm), then the thickness $t_d$ is below 0.0070 in (0.018 mm), but on average is about 0.0064 in (0.016 mm), the lowest figure being 0.0062 in (0.0157 mm). The final thickness $t_s$, after sizing in the die throat 21, is 0.0060 in (0.015 mm).

Because the final sizing step is only marginal and the main wall thickness reduction takes place when the material is bent under tension in the region 30, no additional lubrication combined with cooling is required. After sizing, therefore, the can is free of residual lubricant necessitating washing of the can before it can be printed, lacquered etc. Moreover, in the case of a tinplate can, the tin coating on the steel is subjected to gentle ironing. In bend stretching the main wall thickness reduction is obtained by bending of the material in the curved portions 30,31 of the S-shaped path. Although frictional forces contribute to the required back tension, this is mainly due to the fact that the material is bent over the first curved radiused edge 16, straightened in the region 24 where provided, and bent again in the opposite direction over the second radiused edge 19. It is of particular significance that the radius $r_B$, and particularly the radius $r_D$, are small and kept within the range to be mentioned later.

It is necessary to avoid excessive friction due to clamping, because this may induce seizure between the die 10 or blank holder 13 surfaces of the cup wall. The presence of the converging face 20 in the die 10 is desirable in order to separate the part portions of the cup wall stressed due to bending from those stressed due to sizing in the die throat. Because there is also quite considerable back tension in the material moving along the converging face 20, less effort is necessary for sizing in the die throat 21.

Material thickness decreases by a substantial amount, the degree of thickness reduction being dependent on the ratio between the radius $r_D$ and the thickness $t_o$, as will be mentioned later.

Figure 4:
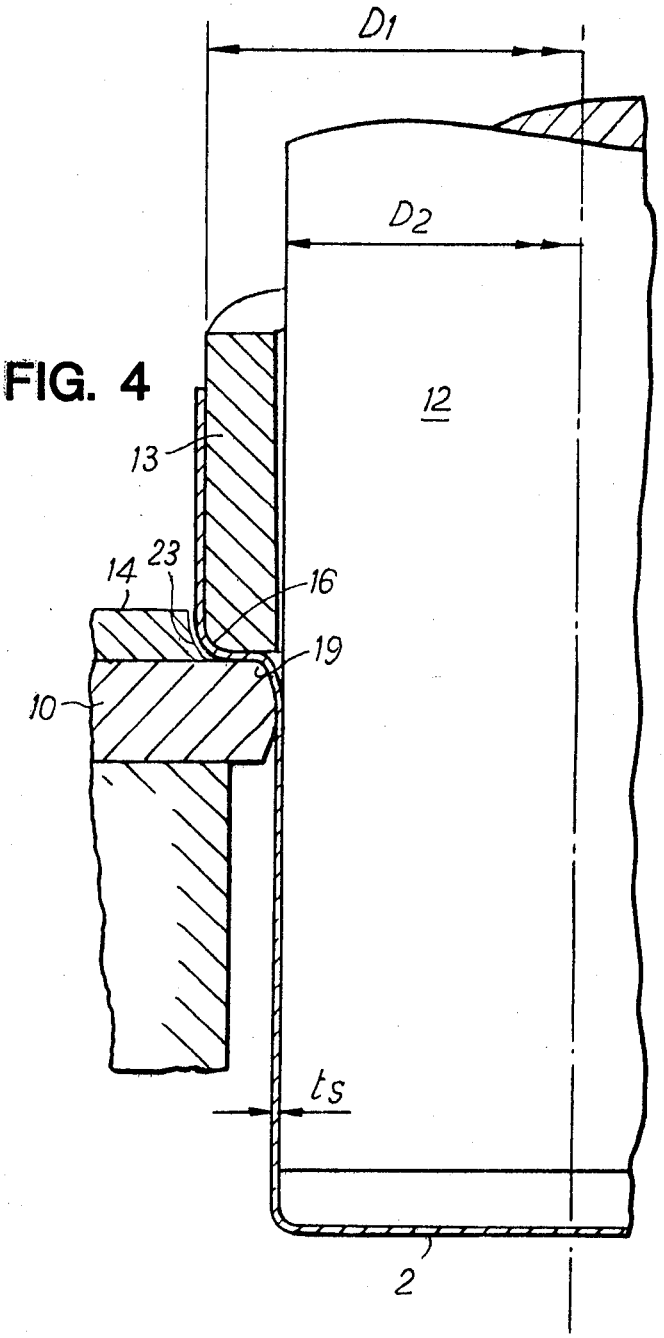
FIG. 4 shows one embodiment of a tool of the kind shown on a larger scale in FIG. 3.

The tool shown in FIG. 4 includes a die 10 and a punch 12, a blank holder 13 and a nest ring 14, generally as already described.

Figure 5:
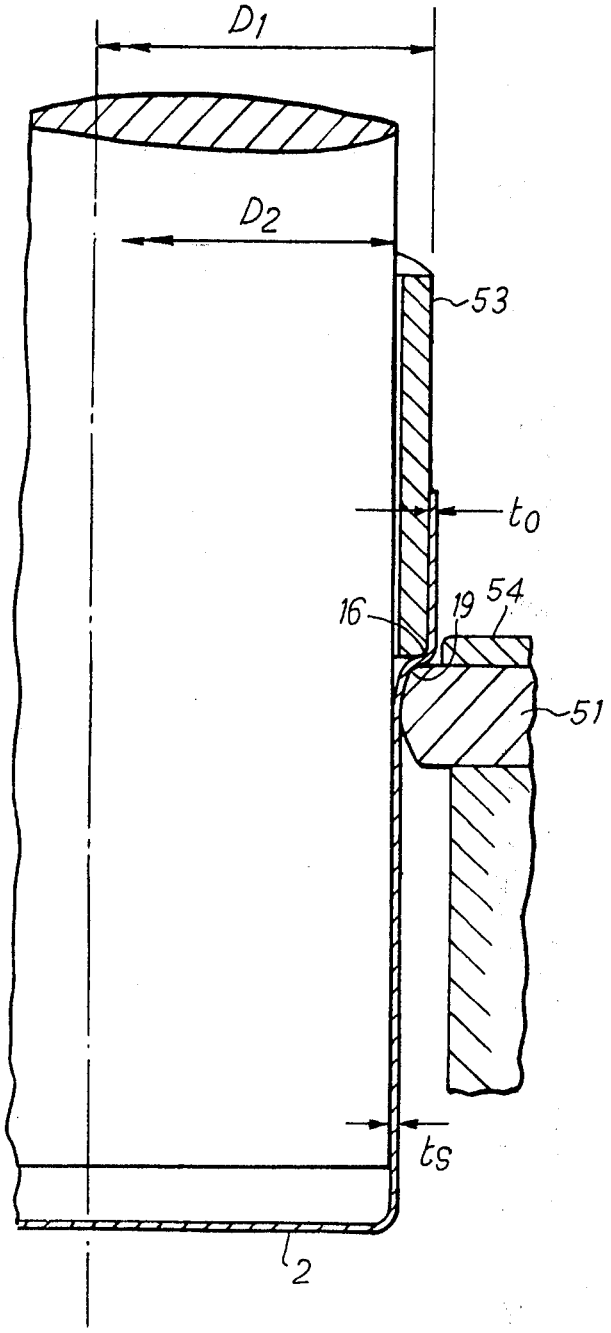
FIG. 5 shows another embodiment of tool according to the invention.

The tool shown in FIG. 5 has a nest ring 54 without a concave portion, and there is no horizontal flat region such as 24 between the blank holder, 53, and and the die, 51, so that the curved portion of the path defined by the radiused edge 16 merges directly into that defined by the radiused edge 19. By contrast with the blank holder 13 of FIG. 4, the blank holder 53 is of the minimum practicable width, which is approximately equal to $r_B+r_D$ (see FIG. 3).

The second redrawing step combined with sizing (represented in FIG. 2 by the curve R2*d*) resulted in a reduction in cup diameter of about 20%. As indicated earlier the smallest diameter reduction will be limited by the minimum possible width of the blank holder in which the S-shaped path has no intermediate region 24.

Experimental work on tinplate cups has shown that the minimum value of the radius $r_D$ of the edge 19 (FIG. 3) is equal to 3 times the thickness $t_o$, whilst its maximum value should be below 4 times the wall thickness $t_o$ for bend stretching to be fully effective, leaving only slight sizing to be done in the throat 21. If more work is required in the sizing operation, then excessive heat is generated which in turn would cause melting and reflowing of tin, thus spoiling the surface quality. The value of the radius $r_B$ should be within the same range.

The bend stretching operation uses a very small blank-holding force, which can be kept almost to zero if the blank holder is radially narrow enough and the radii $r_B$ and $r_D$ are near their minimum values. The blank holder therefore acts essentially as a guide for the cup material in its radially inward movement between the curved path portions 30 and 31. The process is equally effective for smaller and larger diameter reduction. The upper limit of the diameter reduction can only be determined in practice and depends on a number of parameters, but mainly on the mechanical properties of the basic material of the can.

The basic material of the can may be a sheet metal such as aluminium or steel, which may be coated with tin or other electroplating materials, such as chromium or chromium and chromium oxide. The sheet metal may be coated with a suitable lacquer or other organic coating before drawing. Laminates of sheet metal and organic films may also be used.

Figures 6, 6I:
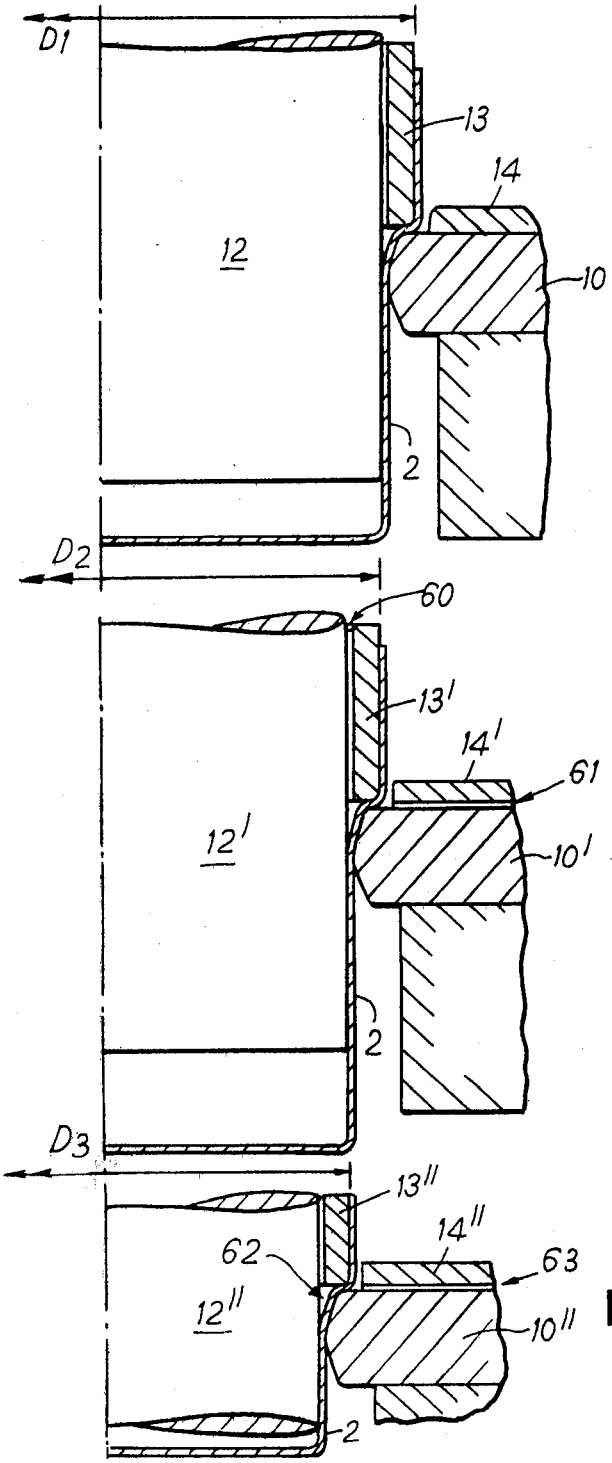
FIGS. 6(*i*)–(*iii*) illustrates three discrete and successive bend-stretch-size operations.

FIG. 6(*i*)–(*iii*) show, reading downwardly, three discrete and successive band-stretch-size steps which may be performed in three successive tools 10,12–14; 10',12',13',14'; and 10'',12'',13'',14'' respectively, as three stages of the second redrawing operation. If these three steps are to be used the first redrawing step may be left out in suitable circumstances. In the second step, a suitable mist lubricant may be introduced between the punch 12' and blank holder 13' and between the die 10' and nest ring 14', as indicated at 60 and 61 respectively. In the third step, a similar lubricant may be introduced where indicated at 62 and 63.

We claim:

1. A method of redrawing a pre-drawn metal cup having a sidewall of predetermined initial thickness, to increase its length and reduce both its diameter and its thickness, wherein the cup is engaged internally by a punch and by a guide ring coaxially surrounding the punch, and in this condition is urged forward by the punch along the punch axis so that the material of the cup sidewall is progressively urged radially inwardly past a forward face of the guide ring and, subsequently, axially through an annular die having the same axis, the sidewall material of the cup being subjected in turn to:

(i) elastic radially-inward bending around a curved edge of the guide ring and in intimate contact with the guide ring only;

(ii) elastic bending in the reverse direction through an angle substantially greater than 45 degrees but less than 90 degrees, around a curved edge of the die; and (iii) passing convergently along a convergent bore of the die towards a die throat, whilst the guide ring exerts on the sidewall and an axial pressure sufficient only to guide the sidewall radially past the forward face of the guide ring but insufficient to provide a clamping force, and the sidewall being in contact with only the die throughout steps (ii) and (iii), whereby the thickness of the sidewall is reduced by simple stretching induced by back tension whilst its diameter is reduced by said bending.

2. A method according to claim 1, wherein the cup is of steel, and in steps (i) and (ii) said bending takes place around the curved edges of the guide ring and die respectively, each having a radius whose value is no less than three times, but below four times, the initial thickness of the cup sidewall.

3. A method according to claim 1, wherein the sidewall of the cup is lightly ironed between the punch and die in the die throat, the latter being substantially cylindrical, so as substantially to equalize the wall thickness along its length.

4. A method according to claim 1, wherein the sidewall of the cup is drawn, between step (i) and step (ii), through a radial, straight intermediate portion of the path defined between the guide ring and the die.

5. A method according to claim 1 wherein the cup is redrawn in a succession of discrete stages using a separate one of said tools in each stage.

6. A method according to claim 2, wherein the sidewall of the cup is lightly ironed between the punch and die in the die throat, the latter being substantially cylindrical, so as substantially to equalize the wall thickness along its length.

7. A tool for redrawing a predrawn metal cup having a sidewall of predetermined initial thickness comprising an annular die and a guide ring having a common axis, and a punch coaxially surrounded by the guide ring and movable forwardly along the axis through first the guide ring and then the die, a leading outer edge of the guide ring being curved and subtending an angle of 90 degrees terminating in a first plane radial to said axis, and a rear inner edge of the die being curved commencing in a second plane parallel to the first plane and spaced axially from it by approximately the said initial wall thickness, wherein the zone surrounding the curved edge of the guide ring is free of obstruction, such that the sidewall material, where in intimate contact with that edge, is in such contact only with the guide ring, the curved surface of the die subtending an angle substantially greater than 45 degrees but less than 90 degrees and terminating in a convergent bore of the die leading forwardly to a die throat whose diameter is such that no more than light ironing of the sidewall of the cup can take place therein, the radial space defined between the punch and the die being free of any element of the tool so that any portion of the cup sidewall in said space is in contact with only the die.

8. A tool according to claim 7, for redrawing a said cup of steel having a predetermined initial thickness, wherein each of the curved edges of the guide ring and die respectively has a radius whose value is no less than three times, but below four times, the said initial thickness.

9. A tool according to claim 7 wherein the guide-ring has a substantially planar leading face and the die a substantially planar rear face, said leading and rear faces being disposed opposite each other to define between them a substantially straight radial gap, radially inward of the curved edge of the guide ring and radially outward of the curved edge of the die.

10. A tool according to claim 7 wherein the guide ring has a substantially planar leading face and the die a substantially planar rear face, said leading and rear faces being disposed opposite each other to define between them a substantially straight radial gap, radially inward of the curve edge of the guide ring and radially outward of the curved edge of the die.

11. A tool according to claim 7 wherein a nest ring surrounds the guide ring with an annular gap therebetween.

12. A tool according to claim 11, wherein the nest ring has a concave bore portion radially separated from, but conforming in profile substantially to, the profile of the radiused leading outer edge of the guide ring.

13. A method of redrawing a pre-drawn metal cup having a side wall and an end wall of predetermined initial thickness and a predetermined axial length to reduce the sidewall thickness and increase the axial length comprising the steps of establishing an annular path of travel for the sidewall which in axial cross-section is generally of a funnel-shaped configuration, the funnel-shaped annular path being defined by a cylindrical path portion of a predetermined major diameter merging with a first radiused path portion progressively reducing the major diameter and merging with a radial path portion in turn merging with a second radiused path portion merging with a convergent path portion converging toward a predetermined minor diameter, positioning a pre-drawn metal cup within the cylindrical, first radiused and radial path portions in the absence of mechanical clamping forces; applying an axial force against the end wall to progressively move the latter in and through the convergent path portion while simultaneously bending and stretching the sidewall during its movement through the first radiused, radial and second radiused path portions again in the absence of mechanical clamping forces; and maintaining the size of the annular path as measured generally normal thereto at the cylindrical, first radiused and radial path portions at all times no less than said sidewall predetermined initial thickness whereby the metal cup is reduced in sidewall thickness and increased in axial length.

14. The redrawing method as defined in claim 13 including the step of guiding the sidewall only along its inner surface as the first radiused path portion and only along its outer surface at the second radiused path portion during the movement of the side wall therethrough.

15. The redrawing method as defined in claim 14 including the step of guiding the sidewall along both its inner surface and its outer surface at the radial path portion during the movement of the sidewall therethrough.

* * * * *